US009349558B2

(12) United States Patent
Schwartz et al.

(10) Patent No.: US 9,349,558 B2
(45) Date of Patent: May 24, 2016

(54) MECHANICALLY ACUATED HEAT SWITCH

(75) Inventors: David Eric Schwartz, San Carlos, CA (US); Sean Roark Garner, San Francisco, CA (US); Dirk De Bruyker, San Jose, CA (US); Ricardo Santos Roque, Sunnyvale, CA (US)

(73) Assignee: PALO ALTO RESEARCH CENTER INCORPORATED, Palo Alto, CA (US)

( * ) Notice: Subject to any disclaimer, the term of this patent is extended or adjusted under 35 U.S.C. 154(b) by 626 days.

(21) Appl. No.: 13/312,880

(22) Filed: Dec. 6, 2011

(65) Prior Publication Data

US 2013/0141207 A1 Jun. 6, 2013

(51) Int. Cl.

| | |
|---|---|
| ***F28F 27/00*** | (2006.01) |
| ***H01H 37/02*** | (2006.01) |
| *H01H 57/00* | (2006.01) |
| *H01H 59/00* | (2006.01) |

(52) U.S. Cl.
CPC ..... *H01H 37/02* (2013.01); *H01H 57/00* (2013.01); *H01H 59/0009* (2013.01)

(58) Field of Classification Search
CPC .... H01H 37/02; H01H 57/00; H01H 59/0009
USPC ..... 165/86, 276, 277
See application file for complete search history.

(56) References Cited

U.S. PATENT DOCUMENTS

| | | | | | |
|---|---|---|---|---|---|
| 3,302,703 | A * | 2/1967 | Kelly | F25D 19/006 | 165/276 |
| 3,869,690 | A * | 3/1975 | Hickling | H01H 5/26 | 337/390 |
| 3,957,107 | A * | 5/1976 | Altoz | F28D 15/06 | 165/276 |
| 4,212,346 | A * | 7/1980 | Boyd | F25D 19/006 | 165/277 |
| 5,379,601 | A * | 1/1995 | Gillett | F25D 19/006 | 165/275 |
| 5,445,308 | A * | 8/1995 | Nelson | C09J 9/02 | 228/121 |
| 6,665,186 | B1 * | 12/2003 | Calmidi | H01L 23/16 | 165/80.4 |
| 6,768,412 | B2 * | 7/2004 | Becka | H01H 1/0036 | 251/129.02 |
| 6,804,966 | B1 * | 10/2004 | Chu | F25B 21/02 | 257/E23.082 |
| 6,871,538 | B2 * | 3/2005 | Fujiwara | G01F 1/6965 | 73/204.26 |
| 6,876,130 | B2 * | 4/2005 | Wong | H01H 55/00 | 200/182 |
| 6,946,776 | B2 * | 9/2005 | Fong | G02B 26/004 | 200/182 |
| 7,191,823 | B2 * | 3/2007 | Harker | B82Y 10/00 | 165/276 |
| 8,093,968 | B2 * | 1/2012 | Naito | B81B 3/0005 | 200/181 |
| 8,286,696 | B2 * | 10/2012 | Grayson | F28F 13/00 | 165/277 |
| 8,619,350 | B2 * | 12/2013 | Lee | G02B 26/001 | 324/458 |
| 8,659,903 | B2 * | 2/2014 | Schwartz | F25B 21/02 | 165/276 |
| 9,010,409 | B2 * | 4/2015 | De Bruyker | H01L 23/34 | 165/276 |
| 2003/0119221 | A1 * | 6/2003 | Cunningham | B81B 3/0024 | 438/52 |
| 2006/0066434 | A1 * | 3/2006 | Richards | B82Y 30/00 | 337/14 |
| 2007/0205473 | A1 * | 9/2007 | Youngner | B81B 7/0087 | 257/414 |
| 2007/0257766 | A1 * | 11/2007 | Richards | B82Y 10/00 | 337/298 |
| 2008/0135386 | A1 * | 6/2008 | Bozler | H01H 59/0009 | 200/181 |
| 2010/0126834 | A1 * | 5/2010 | Ikehashi | G11C 23/00 | 200/181 |

* cited by examiner

*Primary Examiner* — Ljiljana Ciric
(74) *Attorney, Agent, or Firm* — Marger Johnson

(57) ABSTRACT

A heat switch has a first contact, a plug of thermally conductive material, and a mechanical actuator attached to the plug of thermally conductive material, the mechanical actuator arranged to move the plug into contact with the first contact in a first position and to move the plug out of contact with the first contact in a second position responsive to an input signal.

16 Claims, 3 Drawing Sheets

MECHANICALLY ACUATED HEAT SWITCH

RELATED APPLICATIONS

This application is related to co-pending patent application Ser. No. 13/312,849 filed on Dec. 6, 2011, now U.S. Pat. No. 8,659,903, titled, "HEAT SWITCH ARRAY FOR THERMAL HOT SPOT COOLING;" and Ser. No. 13/299,729 filed Nov. 18, 2011, now U.S. Pat. No. 9,010,409, titled, "THERMAL SWITCH USING MOVING DROPLETS."

BACKGROUND

Active thermal switches operate between states of thermal conductivity during which the switch transfers heat, and thermal insulation during which the switch conducts less or negligible heat. Miniaturized and/or arrayed active thermal switches could enable a range of new applications, including improving thermal management of integrated circuits and chip packages and new energy concepts. Current approaches have been unable to achieve distinct thermal contrast between the high heat conducting state and the low heat conducting state with small form-factors and fast actuation at temperatures suitable for many energy harvesting or cooling applications.

Issues may arise with thermal switches and their thermal conductivity contrast, switching speed, and the ease or difficulty of construction. Thermal conductivity contrast means the ratio of the thermal conductivity with the switch on to the thermal conductivity with the switch off. Many current approaches do not have good contrast. Similarly, many approaches have slow switching speeds between the thermal switch being on and off. Finally, many thermal switches have very complicated manufacturing processes, and use materials that can be difficult to handle or materials that are expensive. It becomes difficult to manufacture current heat switches efficiently and even more difficult to manufacture them in arrays.

DETAILED DESCRIPTION OF THE EMBODIMENTS

Figure 1:
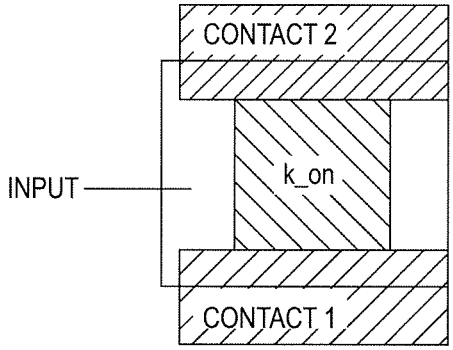
FIG. 1 shows an embodiment of an active thermal switch in an ON state.
Figure 2:
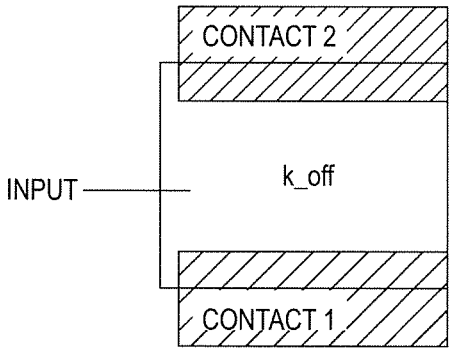
FIG. 2 shows an embodiment of an active thermal switch in an OFF state.

An 'active' heat switch generally consists of a device with one or more thermal conductivities selectable by an input signal, such as a voltage. A two-port active heat switch has two contacts and accepts an input signal, shown in FIGS. 1 and 2. At one value of the input in FIG. 1, the thermal conductance between the contacts has a relatively high value, k_on. At a different value of the input in FIG. 2, the thermal conductance between the contacts has a low value, k_off. Heat transfers more easily between the contacts in the ON state than the OFF state. One can characterize the thermal or heat switch in part by K, the ratio of k_on to k_off, K=k_on/k_off, and the switching speed. In general, applications prefer higher K and faster switching speeds, with their relative importance depending upon the application.

Figure 3:
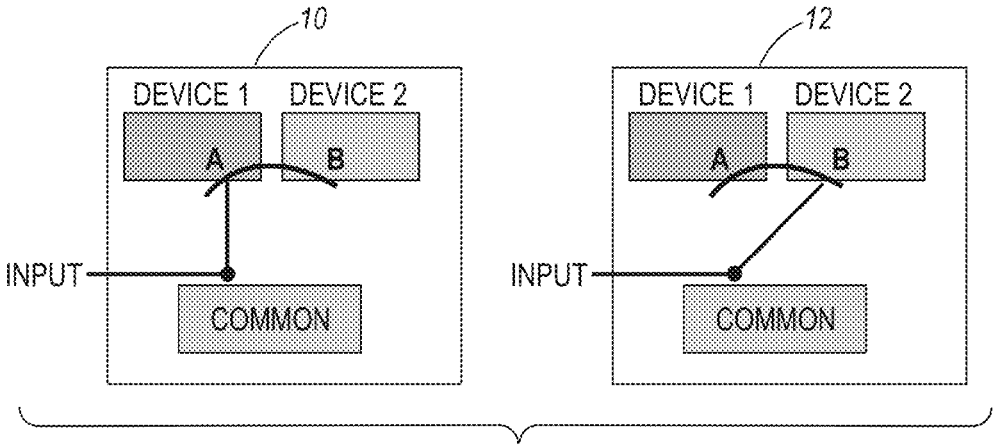
FIG. 3 shows embodiment of a single pole double throw heat switch.

A 'single-pole, double-throw' (SPDT) active heat switch selectively creates a high thermal conductance path between a common node and one of two target nodes in response to an input signal. FIG. 3 shows an example. The SPDT active heat switch receives an input signal that causes the switch to connect device A to the common terminal at the configuration labeled 10. This forms a path of relatively high thermal conductance between the node A and the common terminal. The thermal conductance between the node B and the common terminal remains relatively low. At the configuration labeled 12, the input signal causes the switch to connect between B and the common terminal, forming a relatively high thermal conductance path, with a lower thermal conductance path between A and the common terminal.

Note that the terms high and low as used here are relative to each other, where one path is higher or lower than the other. Additionally, k_on_A will typically approximately equal k_on_B, and k_off_A will equal k_off_B, but any pairs of relatively high and relatively low thermal conductance can be used.

An alternative to an SPDT switch includes a third state in which the thermal conductance between the common and both A and B has a low value. Yet another alternative allows a fourth state in which the thermal conductance between C and both A and B is relatively high. In addition, alternatives having more than one pole and/or more than two throws could also exist. Design of these and other similar variations is an obvious extension of this description and is not further discussed.

Figure 4:
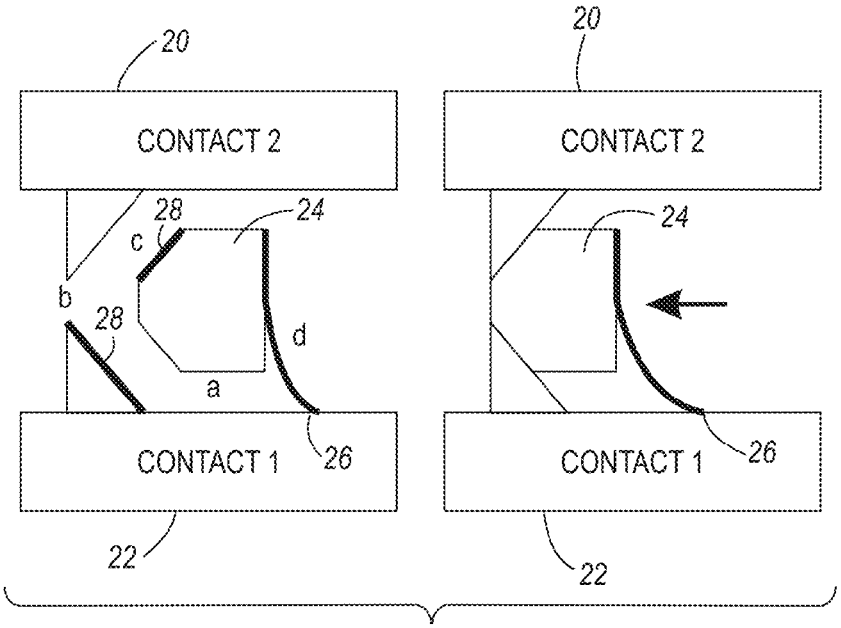
FIG. 4 shows an embodiment of a single-pole double-throw plug heat switch.

This discussion focuses on individual heat switches, with the understanding that these switches may reside in an array of individually addressed heat switches. FIG. 4 shows an embodiment of a 'plug' heat switch. The switch consists of a plug 24 of relatively high thermal conductivity material, such as metal or silicon, attached to a mechanical actuator 26. The mechanical actuator changes the position of the plug in response to a signal from a signal source, not shown. The signal may be voltage, current, electromagnetic, mechanical, etc.

The contacts 20 and 22 have protrusions or other surfaces that allow the plug to connect the two contacts. In the OFF position, the plug 24 lies apart from the contacts 20 and 22, leaving a gap. The gap may have gas or liquid in it, or a low or high degree of vacuum. Higher vacuums result in lower thermal conductance in this state. Regardless if the gap has gas, including air, liquid, or vacuum, the path between the contacts has relatively low thermal conductance. The gas, liquid, or vacuum gap dominates the thermal resistance in the OFF position.

Upon receipt of a signal, the mechanical actuator 26 moves to bring the plug 24 into contact with the contacts 20 and 22. The thermal conductance between the two contacts is high, with the thermal resistance consisting of the sum of the resistance of the thermal connectors of the contacts, the interface material 28 and the plug 26. The contact may be made through a thermal connect, such as a volume of metal or silicon, or another relatively high thermal conductivity material. A thermal interface material 28, such as thermal grease, a carbon nanotube turf, an array of liquid metal droplets, a liquid metal film, etc., may reside at the contact interface. It may cover one or both sides of the interface.

In addition, depending upon the interface material, a higher pressure applied to the plug may generate a higher thermal conductance at the interface. The higher pressure may result from a higher impetus from the signal, an attractive force between the contacts and the plug, etc.

An array of switches such as the above may connect a single substrate to several contacts, with each switch connected to a same first contact but different second contacts. A high thermal conductivity path can form between the substrate and certain top contacts and not others. This is discussed in more detail in co-pending patent application, Ser. No. 13/312,849.

The array of switches may be individually addressable at each actuator. The actuators may consist of one of many different mechanisms. For example, electrostatic actuation may be used. The plug attaches to the actuator, in this case a cantilever, positioned so that the OFF state requires no applied signal. One method of creating such a cantilever is with a stressed metal release process. When the switch is turned ON, such as by application of a voltage across the gap and another electrode, possibly on the substrate or on the thermal connectors on the contacts. The resulting charging of the interface attracts the plug, causing the actuator to move to close the gap. The displacement, spring constant of the actuator and applied force would be optimized for each design. Some general principles will apply to all designs, that the displacement be large enough that the thermal contact is poor in the OFF state, yet small enough that the force to overcome the spring force is able to be generated, and it must enable a large thermal conductivity at the interface in the ON state. Alternatively, the switch may be normally in the ON state and be switched to the OFF state upon application of the signal.

Another possibility involves piezoelectric cantilevers. The application of a voltage would cause a piezoelectric cantilever to bend, bringing the plug into contact. The actuator 36 may consist of a piezoelectric stack, such as one of lead zirconate titanate. This may generate up to 10 MPa of pressure or a 0.1% strain.

Further, the cantilever may consist of an electromagnetic cantilever. The cantilever may consist of a ferromagnetic material. Current applied to an electromagnet, such as a coil of conductive material on the substrate, would generate an attractive force.

Figure 5:
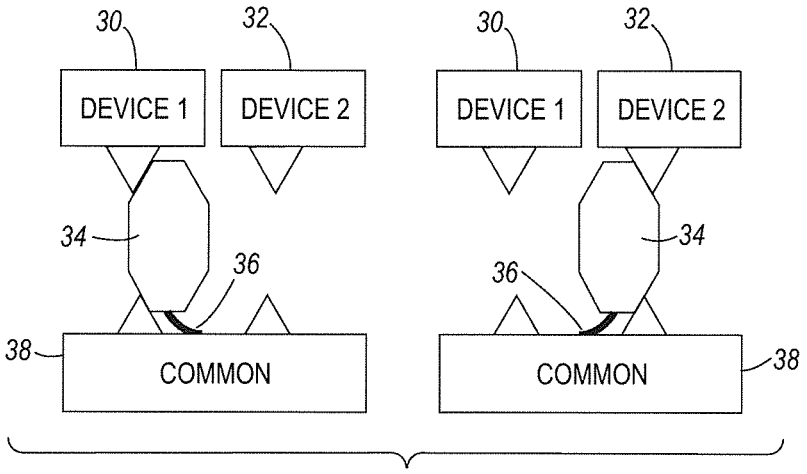
FIG. 5 shows an alternative embodiment of a plug heat switch.

The switch of FIG. 4 consists of an ON/OFF switch. FIG. 5 shows an alternative architecture, that of a single pole double throw (SPDT) switch. The plug selectively makes contact with one of two contact regions or devices. For example, the left side of FIG. 5 shows the plug 34 making contact between a common contact 38 and a first device or region 30, based upon the position of the actuator 36. This forms a high thermal conductance path between device 30 and the common contact 38. On the right side, the plug has moved to a different position, forming a path of high thermal conductance between the second device or region 32 and the common contact 38.

As mentioned above, a third signal may cause the actuator to move the plug to a neutral position, making no contact with either 30 or 32. Additionally, depending upon the shape of the plug and the thermal connectors of the contacts, it is possible that a greater movement would form contacts between the common terminal 38 and both devices or regions 30 and 32.

Figure 6:
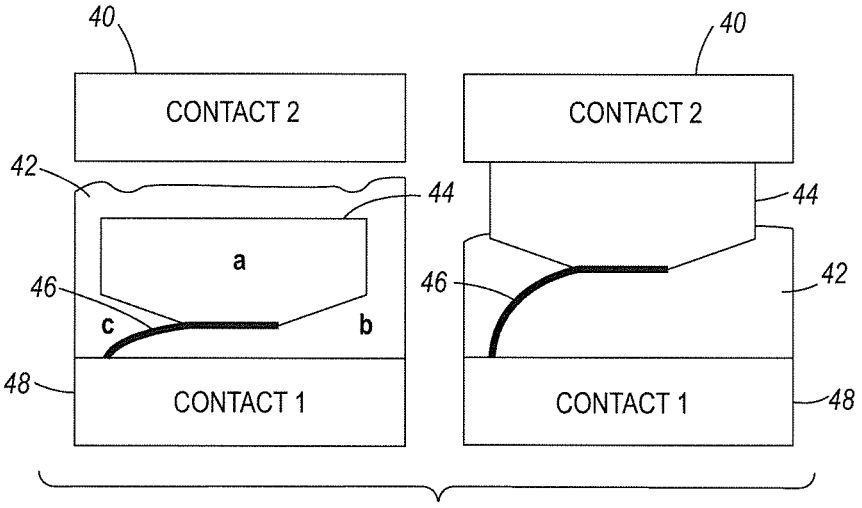
FIG. 6 shows an embodiment of a plug heat switch having a liquid filled cavity.

Other types of switch architectures are also possible. FIG. 6 shows an alternative switch architecture for an ON/OFF switch, which may adapt to a SPDT type switch, or any other architecture. On the left side of FIG. 6, the switch lies in the OFF position. The space surrounding the plug 44 and the actuator 46 contains a liquid 42 having high thermal conductivity. Depending upon the application, the liquid should not be electrically conductive, as it may interfere with the operation of the electrostatic actuator. Examples of non-electrically conductive liquids include thermal greases, oils like mineral oil, water, oil or isopar containing a suspension of ceramic particles, such as beryllium oxide or aluminum nitride.

The OFF position may occur because of a signal that causes the plug to release from the top contact, with the 'passive' state in which there is no signal having the plug in contact. Alternatively, the passive state may have the plug in the OFF state, with the application of a signal causing the plug to make contact. In the OFF state, the plug may submerge in the liquid 42, or remain above the surface. The high thermal resistance of the gap dominates the thermal conductivity of the switch.

In the ON position, the plug contacts the top contact 40, either by application or removal of the signal to the actuator 46. Again, a thermal interface material may exist on the contact between the plug and the contact. The thermal path of the switch includes the thermal conductance of the plug and the liquid, forming a high thermal conductance path to the bottom contact 48. This configuration may achieve a much higher fill-factor of an array of switches.

It will be appreciated that several of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A heat switch, comprising:

a substrate;

an array of heat switches connected to the substrate as a first contact, each heat switch comprising:

a plug of thermally conductive material; and a mechanical actuator attached to the plug of thermally conductive material, the mechanical actuator arranged to move the plug into contact with the first contact in a first position and to move the plug out of contact with the first contact in a second position responsive to an input signal.

2. The heat switch of claim 1, wherein the plug of thermally conductive material consists of either metal or silicon.

3. The heat switch of claim 1, wherein the first contact consists of a thermally conductive material, metal or silicon.

4. The heat switch of claim 1, further comprising a thermal interface material on at least one of the plug and the first contact.

5. The heat switch of claim 4, wherein the thermal interface material is one of thermal grease, material having carbon nanotubes, an array of liquid metal droplets, or a liquid metal film.

6. The heat switch of claim 1, wherein the mechanical actuator is arranged to apply pressure to the plug in the first position.

7. The heat switch of claim 1, the switch further comprising a second contact arranged adjacent the first contact across a gap, the mechanical actuator arranged to move the plug at least partially into the gap in the first position to form a connection between the first and second contacts.

8. The heat switch of claim 1, wherein the mechanical actuator comprises one of an electrostatic cantilever, piezoelectric cantilever, or an electromagnetic cantilever.

9. The heat switch of claim 1, the switch further comprising:

a first device thermally connected to the first contact;

a second device thermally connected to a second contact; and a common contact arranged across a gap between the first and second contacts, the mechanical actuator arranged to move the plug to the first position between the first contact and the common contact and a second position between the second contact and the common contact.

10. The heat switch of claim 9, the switch further comprising thermal interface material on the first and second contacts.

11. The heat switch of claim 9, wherein the mechanical actuator is arranged to move the plug to a third position at which the plug is away from both the first and second contacts.

12. The heat switch of claim 9, wherein the mechanical actuator is arranged to move the plug to a third position at which the plug makes contact with both the first and second contacts.

13. The heat switch of claim 1, the switch further comprising:

a second contact arranged opposite a gap from the first contact;

a thermally conductive but electrically insulative liquid in the gap; and the mechanical actuator arranged to move the plug to a first position adjacent the first contact, and to move the plug into contact with the second contact responsive to signals received on the first and second contacts.

14. The heat switch of claim 13, wherein the thermally conductive liquid comprises one of thermal grease, oil, water, mineral oil, isopar containing a suspension of ceramic particles.

15. The heat switch of claim 14, wherein the ceramic particles comprise one of beryllium oxide or aluminum nitride.

16. The heat switch of claim 13, the switch further comprising a thermal interface material on at least one of the second contact and the plug.

* * * * *